United States Patent [19]

Zimmerman

[11] 4,451,154

[45] May 29, 1984

[54] MIXING DEVICE

[76] Inventor: James Zimmerman, P. O. Box 444A, New Holland, Pa. 17557

[21] Appl. No.: 300,905

[22] Filed: Sep. 10, 1981

[51] Int. Cl.[3] ..... B01F 15/02

[52] U.S. Cl. ..... 366/186; 366/135; 366/187; 366/192; 366/228; 366/233; 366/603

[58] Field of Search ..... 366/3, 10, 12, 13, 14, 366/15, 27, 28, 30, 38, 42, 44, 50, 53–59, 77, 91, 92–95, 131, 133, 135–137, 184–188, 219, 220, 222–225, 227–229, 233, 235, 261, 262, 266, 79, 318, 341, 347, 349, 603

[56] References Cited

U.S. PATENT DOCUMENTS

| | | | |
|---|---|---|---|
| 302,420 | 7/1884 | McKeage et al. | 366/135 |
| 1,713,568 | 5/1929 | Swenson | 366/186 |
| 2,112,848 | 4/1938 | Jackson | 366/135 |
| 2,512,095 | 6/1950 | Endsley | 366/187 |
| 2,764,392 | 9/1956 | Fisher | 366/228 |

*Primary Examiner*—Timothy F. Simone
*Attorney, Agent, or Firm*—Weiser, Stapler & Kimmelman

[57] ABSTRACT

A mixing device for forage and similar product has a rotatable, sloping mixing chamber with its closed rear axial end lower than its open forward axial end. The forward end receives and discharges the forage. Generally linear mixing vanes extend forwardly from adjacent the rear end of the mixing chamber for tumbling the forage during chamber rotation. An axial tubular housing within the mixing chamber encloses a rotatable axial auger, which communicates with the rear end of the mixing chamber to receive forage from the mixing chamber and feed it back toward and out of a forward end of the housing.

11 Claims, 5 Drawing Figures

MIXING DEVICE

TECHNICAL FIELD

This invention relates generally to mixing devices, and more specifically to a mixing device for forage and similar product.

BACKGROUND ART

In order to provide a balanced diet for cattle and other livestock it is often necessary to mix together different types of forage (e.g. straw, hay, corn, etc.). Rotary-type tumblers have been employed for this purpose; one such tumbler, or mixer being referred to as Roll-A-Mix, and is sold by Steiner Corp. of Orrville, Ohio. The Steiner device employs a cylindrical mixing chamber that is closed at its opposite axial ends. An in-feed hopper is located adjacent the forward end of the mixing chamber and communicates with one end of an auger that extends axially through said chamber. A tubular housing surrounds the auger, and terminates close to, but short of the rear end of the chamber. Forage directed into the in-feed hopper will be directed by the auger through the tubular housing, and out the rear end thereof into the rear of the mixing chamber.

The above-described arrangement for loading the mixing chamber is quite inefficient. First, the loading operation is speed limited by the capacity of the auger feeding system. Secondly, virtually nothing happens to the forage during the period of time it is being directed by the auger to the rear of the mixing chamber. Stating this another way, the auger is not a very effective mixing device, and therefore, virtually no mixing takes place as the forage is being moved by the auger. This is an extremely inefficient use of processing time.

In use, the Steiner mixer is rotatably mounted in a substantially horizontal plane, i.e. the central axis of the mixing chamber is substantially horizontal. Spiral flights are secured to the inner peripheral wall of the mixing chamber and extend for substantially the entire axial extent thereof. These spiral flights are intended to engage the forage at the rear end of the mixing chamber and tumble it in a forward direction to the front end of the chamber. At the front of the chamber the forage can again be deposited on the auger for recycling through the mixing operation. That is, the auger will again feed the initially mixed material to the rear of the mixing chamber where it is again intended to be tumbled forward for further mixing. The mix can be cycled as many times as is believed to be necessary.

The spiral flights need to be designed to both tumble the forage and move it axially to the front of the mixing chamber. The orientation of the flights necessary to move the forage axially is not the most desired orientation for achieving an effective mixing or tumbling action. Therefore, by necessity, the arrangement of the spiral flights in the Steiner device represents a compromise construction, and does not provide the most effective mixing action possible. In fact, if the cylindrical chamber is only partially filled with forage, the spiral flights tend to actually push the forage along lower surface regions of the chamber with very little lifting and/or mixing action. Since the mixing action is inefficient, the forage generally has to be recycled an excessive number of times to achieve the desired degree mixing.

In the Steiner device the auger is utilized in both the loading and unloading operations. When the mixing of the forage is complete, a reversable motor is employed to reverse the direction of rotation of the auger. When this occurs, the forage directed by the spiral flights into the auger at the forward end of the mixing chamber will be conveyed out of the device rather than being recycled. Since the Steiner device utilizes the auger for both the loading and unloading operations, a reversable motor needs to be used. This represents a somewhat more costly and complex arrangement than one in which the reversability is not required.

The Steiner system is limited to a batch-type operation. That is, once the mixing chamber has been completely loaded it can either be employed to continuously cycle the material within the chamber (when the auger is being rotated in a direction to feed material into the chamber), or it can be operated to unload the chamber (when the auger is being rotated in the opposite direction). Since the auger is utilized to both recycle the material within the chamber and also to unload the chamber, the mixing device is not capable of operating in both modes at the same time.

In the Steiner device the axially extending tubular housing around the auger does not rotate, and forage directed through the mixing chamber tends to be deposited and build up on its upper surface. Periodically it is necessary to stop the operation of the mixing device and actually brush off the accumulation of forage; an added maintenance step that is both inefficient and undesirable.

The present invention is intended to overcome the many deficiencies described above in connection with the Steiner device.

SUMMARY OF THE INVENTION

A mixing device for forage and similar product includes a rotatably mounted, inclined mixing chamber having a rear axial end lower than a forward axial end thereof. The rear axial end is sealed, and the forward end has a forage receiving opening into which forage can be directed. A peripheral mixing zone of the chamber is provided with substantially linear mixing vanes extending longitudinally along an interior wall of the mixing chamber. These vanes project radially inwardly for engaging and tumbling forage when the chamber is rotated. A rotatably mounted auger extends axially within the chamber and is surrounded by an axially extending tubular housing that separates the auger from the mixing zone. However, the auger does communicate with the rear axial end of the mixing zone through a rear opening in the housing for receiving forage from the mixing zone and feeding it toward, and out of a forward axial end of the housing.

Reference throughout this application to mixing vanes being "substantially linear" is intended to include mixing vanes that are straight, as well as vanes having some curvature over their longitudinal, or axial dimension. However, the substantially linear mixing vanes do not make a complete revolution about the circumference of the mixing chamber between the rear and forward axial ends thereof. This is in distinction to the spiral mixing vanes in the Steiner mixer, wherein the spiral flights make several revolutions about the circumference between the rearward and forward end of the mixing chamber.

The above-described arrangement of elements in applicant's mixing device provides several advantages over the Steiner device. First, in applicant's device the auger is not employed to initially feed forage into the mixing zone. The forage can be directly shoveled into the mixing zone through the forward open end of the mixing chamber, and therefore, the loading operation is not speed limited by the rotational speed of the auger.

Secondly, the substantially linear mixing vanes are much more efficient in tumbling and intermixing the forage than the spiral flights employed in the Steiner mixer. This is due to the fact that the vanes in applicant's device are designed for the principal purpose of tumbling the forage; not for moving it axially through the mixing chamber. The latter function is accomplished by the inclined mounting of the mixing chamber. Therefore, unlike Steiner, the design of the mixing vanes in applicant's device does not represent a compromise design for both axially moving and tumbling forage.

In applicant's invention a mineral, such as salt, can be directly added to the forage by shoveling it into the open end of the mixing zone. This permits the salt to be initially dispersed along the axially extent of the mixing zone so that it thereafter can be readily intermixed with the forage through rotation of the mixing chamber. In the Steiner device any mineral that is added to forage in the mixing chamber must be inserted through the hopper communicating with the auger, and the mineral will be dumped into the mixing zone only at the rear end of the chamber. Depositing all of the mineral at the rear of the mixing zone makes it virtually impossible to intimately mix it with all the forage previously introduced into the mixing chamber.

In applicant's device the auger is only employed to direct forage from the rear, or lower end of the inclined mixing chamber to the forward end of said chamber. A hinged flap, or similar forage directing element is mounted adjacent the forward end of the tubular housing and is movable between one position for directing the forage exiting the forward end of the housing out of the mixing chamber, and a second position for redirecting the forage back into the mixing zone. This provides an extremely simple arrangement for either recycling the forage for further mixing, or directing it out of the mixer, as desired. Because of this arrangement, the direction of auger rotation does not need to be reversed, as in the Steiner device. Therefore, unlike Steiner, applicant does not require the use of a reversable motor, thereby resulting in a less costly and simpler arrangement of elements.

Unlike the Steiner device, applicant's device is not limited to a batch-type operation. Specifically, applicant can continously shovel, or otherwise feed forage into the entrance end of the mixing zone while continuously removing forage from the chamber through the rotatable action of the auger. In the Steiner device, material cannot be directed into the zone at the same time that the auger is being operated to remove forage from the chamber. This should be apparent since Steiner relies upon the auger itself both to feed forage into the mixing chamber and to remove it therefrom.

In the preferred arrangement of applicant's device the tubular housing surrounding the rotatable auger is rotatably mounted with the mixing chamber. Accordingly, when the mixing chamber is rotated to tumble and intermix the forage the housing surrounding the auger also is rotated. This prevents a buildup of forage on the housing, and thus eliminates the need to stop the operation of the mixing device to brush off accumulated forage; a problem that does exist in the Steiner device.

In the preferred embodiment of applicant's device a stationary forage-receiving chamber is retained adjacent the rear axial end of the mixing chamber, and has an opening therein for communicating the mixing zone with a rear end of the auger. This opening has at least one substantially curved edge which is laterally spaced from a second edge at one axial end of the opening, and which curves into engagement with the second edge at the opposite axial end of said opening to form a point. The curved edge cooperates with flights of the auger to provide a scissors-like cutting action for the purpose of cutting, or otherwise shredding forage that tends to bunch up and block the opening into the forage-receiving chamber. Most preferably the auger is rotated in a direction opposite to the direction of rotation of the mixing chamber to assist in pulling the forage into the forage-receiving chamber. If the auger were rotated in the same direction as the mixing chamber it would tend to "throw out" the forage from the forage-receiving chamber, rather than pulling it in.

In the preferred embodiment of this invention each of the substantially linear mixing vanes includes a loading fin adjacent the rear axial end thereof. The loading fins extend radially into the mixing zone a greater distance than forward regions of the vanes and are in axial alignment with the opening in the stationary forage-receiving chamber. The loading fins function to lift forage directed to the rear end of the mixing zone and feed it directly into the opening of the forage-receiving chamber.

Other objects and advantages of this invention will become apparent by referring to the Brief Description of the Drawings, taken in conjunction with the Descripton of the Preferred Embodiment of the Invention.

DESCRIPTION OF THE PREFERRED EMBODIMENT OF THE INVENTION

Figure 1:
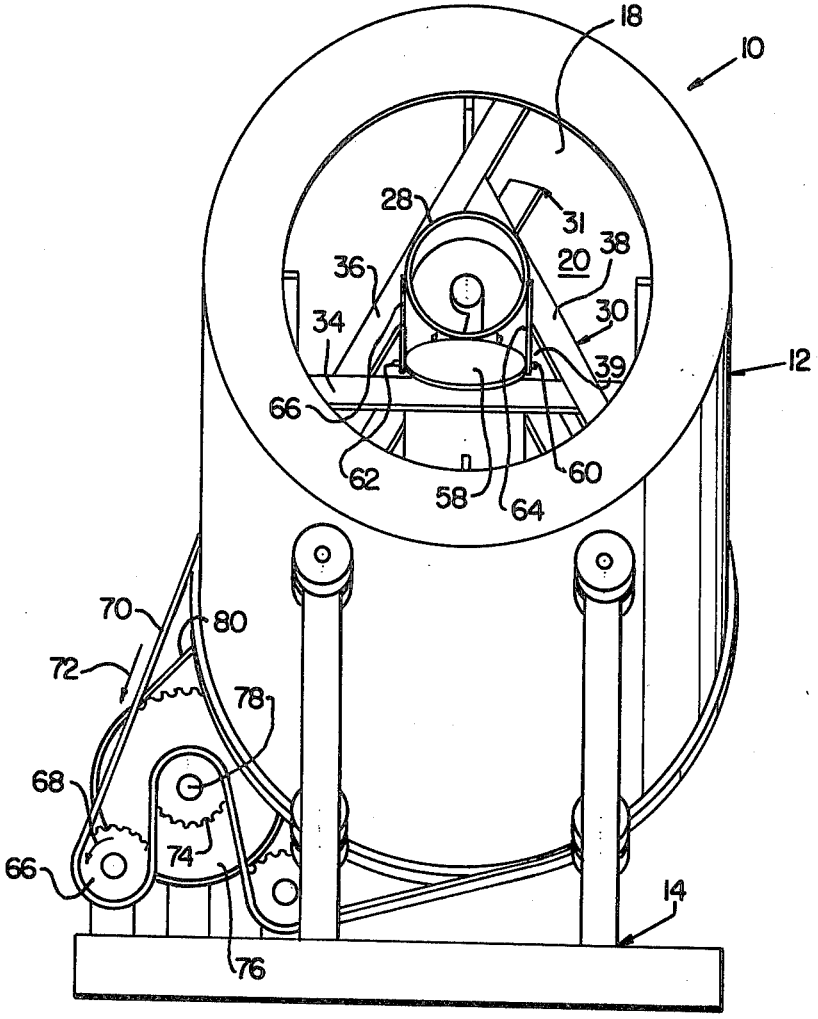
FIG. 1 is a front elevation view of the mixing device of this invention.
Figure 2:
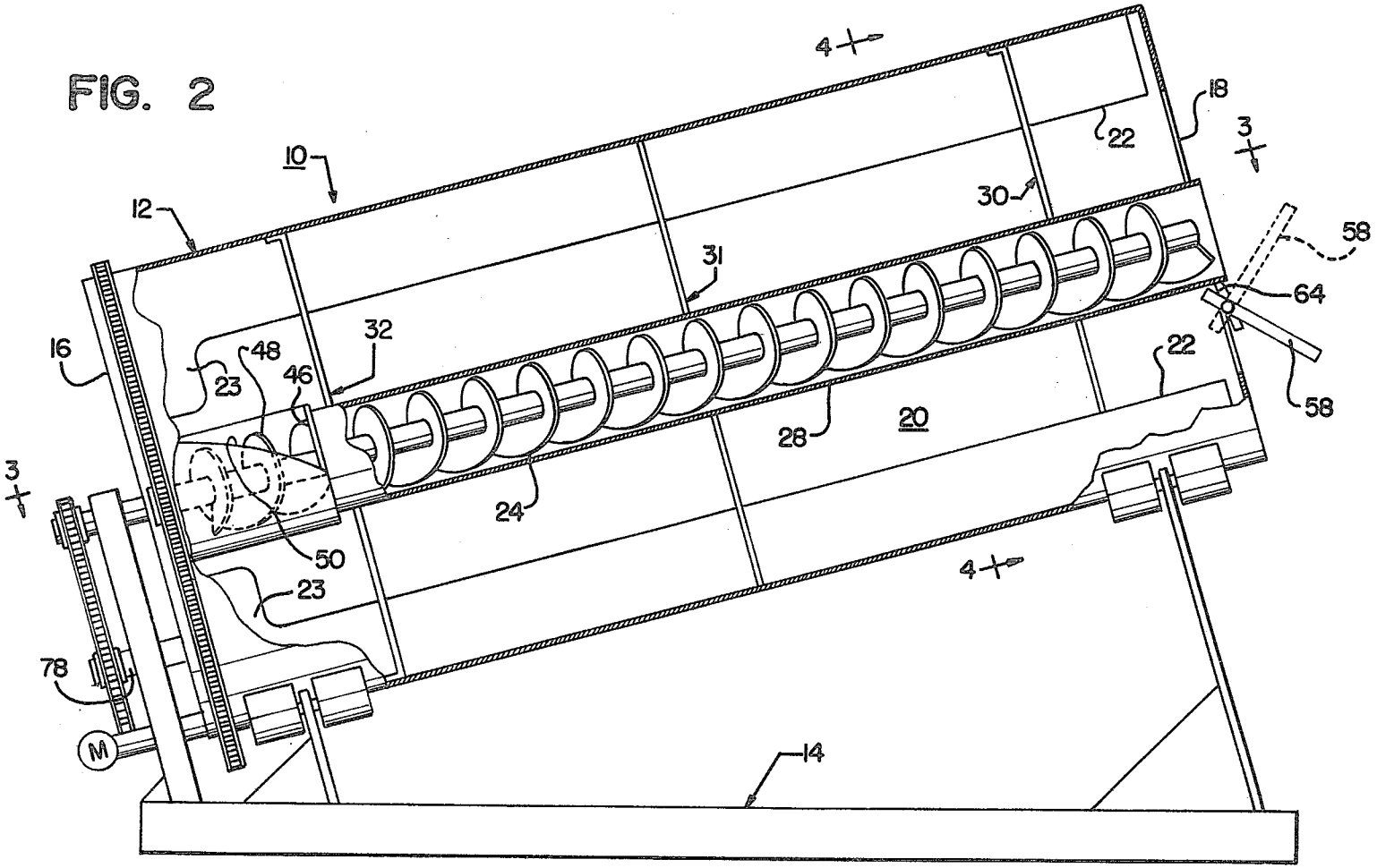
FIG. 2 is a side elevation view of the mixing device with regions of the outer walls of the mixing chamber and the tubular housing surrounding the auger being broken away, and elements of the bracing system joining the housing to the mixing chamber being removed, all to show details of construction.
Figure 3:
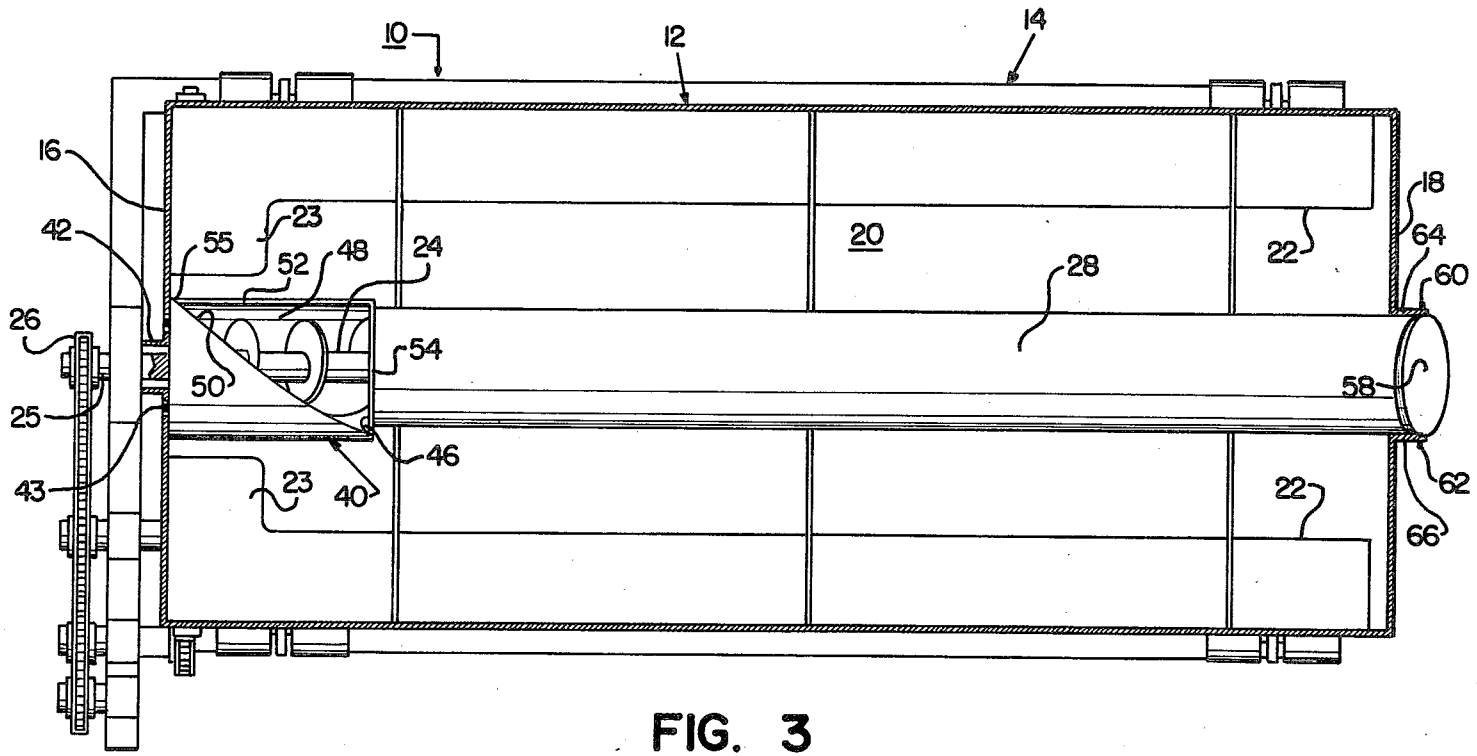
FIG. 3 is a sectional view taken along line 3—3 of FIG. 2 with element of the bracing system joining the housing to the mixing chamber being removed to show details of construction.

Referring to FIGS. 1–3 the mixing device 10 of this invention includes an inclined mixing chamber 12 rotatably mounted on a support 14. The chamber includes a rear end wall 16 and a forward open end 18 that provides direct communication with a peripheral mixing zone 20.

Figure 4:
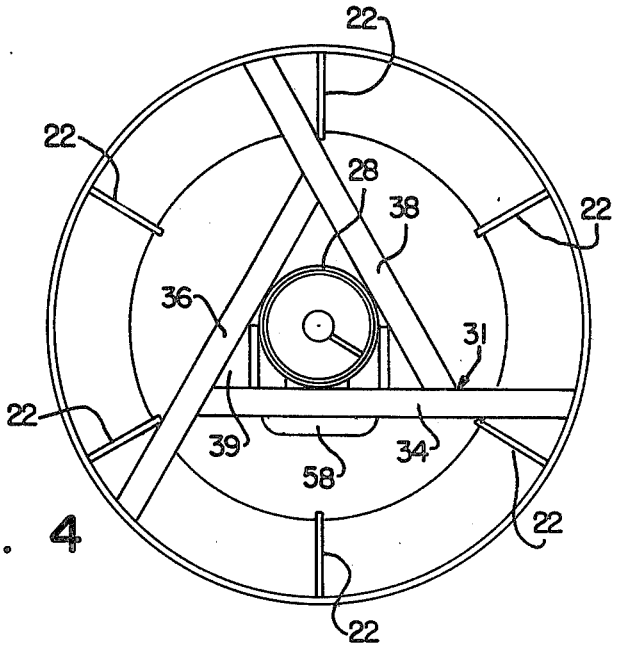
FIG. 4 is a sectional view taken along line 4—4 of FIG. 2.

Referring to FIGS. 2–4, a plurality of identical, substantially linear mixing vanes 22 extend longitudinally along the mixing zone 20, and are joined to the inner peripheral wall of the chamber 12. These vanes are spaced circumferentially about the mixing zone and extend radially inwardly to tumble and intermix forage directed into the mixing zone 20 through the open forward end 18 of the chamber 12. The number of vanes that are employed is a matter of choice; six(6) being depicted in the illustrated embodiment.

Referring specifically to FIGS. 2 and 3, each vane 22 includes a fin 23 at the rear end thereof. These fins extend radially into the mixing zone to a greater extent than forward sections of the vanes, for reasons that will be explained later in this application.

Referring to FIGS. 2–5, an axially extending auger 24 is centrally located within the mixing chamber 12, and extends through the rear axial end wall 16, where it is connected to a driven gear 26. The manner in which the auger 24 is rotated through driven gear 26 will be described later in connection with the drive system shown in FIG. 5.

Referring to FIGS. 1–3, an axially extending tubular housing 28 surrounds the auger for separating a major portion of the auger from the mixing zone 20. The tubular housing is connected to the mixing chamber 12 through axially spaced apart brace system 30, 31 and 32. Referring to FIGS. 1 and 4, each brace system includes three rod-like elements 34, 36 and 38 joined to the inner peripheral wall of the mixing chamber 12 and to each other to form a delta-shaped opening 39. The openings 39 are axially aligned, and the tubular housing 28 extends through these openings and is secured to one or more of the elements (e.g. 34, 36 or 38) of each brace system through suitable fastening means, such as welds. In view of the fact that the brace systems 30, 31 and 32 are connected to both the mixing chamber 12 and the tubular housing 28, positive rotation of the mixing chamber will result in rotation of the housing.

Figure 5:
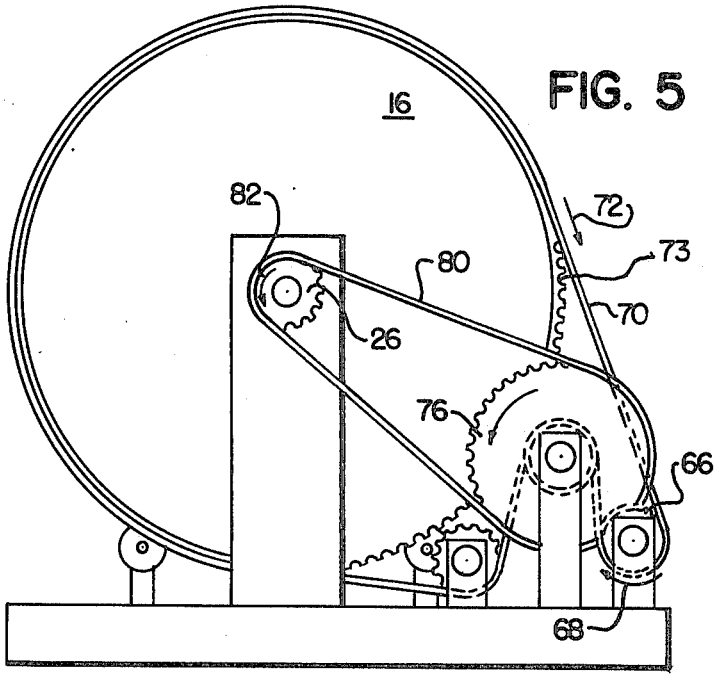
FIG. 5 is rear elevation view of the device.

Referring to FIGS. 3 and 5, a stationary forage-receiving chamber 40 has a rear tubular portion 42 extending through a bearing 43 in the rear end wall 16 of the mixing chamber 12. The rear end 25 of the auger 24 extends axially through the chamber 40 and through the rear tubular portion 42, where it is there connected to the driven gear 26. In order to permit the auger to pass into and through the forage-receiving chamber 40, an opening (not shown) in front wall 46 of the chamber is in axial alignment with the hollow interior of the tubular housing 28.

Referring specifically to FIGS. 2 and 3, an opening 48 is provided at the upper surface of the forage-receiving chamber 40. This opening is provided in part by a generally spiral, or curved surface 50, and an axially straight surface 52. These two surfaces are spaced apart at axial end wall 54 of the opening, and come together in a point 55 at the opposite axial end of said opening. The curved surface 50 cooperates with the flights of the auger 24 to provide a scissors-like cutting action that effectively cuts, or shreds forage that otherwise might tend to block the opening 48 into the forage-receiving chamber 40.

Referring to FIGS. 1–3, a flap 58 is hinged at diametrically opposed areas 60 and 62 to spaced flap supports 64 an 66. These latter supports are fixed against movement to diametrically opposed areas of tubular housing 28 by welds or other suitable fastening means. The flap 58 is movable about its hinged connection between the two positions indicated in solid representation and phantom representation, respectively, in FIG. 2. When the flap is positioned in the location shown in solid representation, forage directed out of the tubular housing by rotation of the auger will be directed out of the mixing chamber. When the flap is oriented in the position shown in phantom representation the forage directed out of the tubular housing will be recycled through the mixing zone 20.

Referring to FIGS. 1, 2 and 5 the drive system for rotating the mixing chamber 12 and auger 24 includes a motor driven sprocket 66 that is driven in the direction indicated by arrow 68. This sprocket drives a continuous chain 70 in the direction indicated by arrow 72. The chain 70 meshes with teeth 73 located about the outer periphery of the mixing chamber 12 to likewise rotate the chamber in the direction of arrow 70. Since the elongate tubular housing 28 surrounding the auger is positively connected to the mixing chamber 12, it also will be rotated in the direction of arrow 70.

The continuous chain 70 also drives sprocket gear 74, which in turn drives a larger diameter gear 76 through an interconnecting axle 78. A second chain 80 is driven by gear 76, and is trained about the gear 26 joined to the auger 24. As can be seen in FIG. 5, the gear 26, as well as the auger connected to it, are rotated in the direction of arrow 82, which is opposite to the direction of rotation of the mixing chamber 12.

The above described drive system is designed to rotate the mixing chamber 12 at a considerably slower speed (RPM) than the auger 24. In a preferred embodiment of this invention the mixing chamber is rotated at slow speed of less than 10 revolutions per minute, and most preferably on the order of 2-to-3 revolutions per minute. The auger is rotated through driven gear 26 at a significantly higher speed, in excess of 150 revolutions per minute, and most preferably on the order of about 175 revolutions per minute.

In operation the forage, or other material to be tumbled and mixed, is shoveled directly into the mixing zone 20 through the open forward end 18 of the mixing chamber. Therefore, the loading operation is not in anyway limited by the operation of a conveyor, such as auger 24. The material directed into the mixing zone 20 is tumbled by the vanes 22, and is moved toward the rear axial end wall 16 of the chamber as a result of the inclined orientation of said chamber. When the forage reaches the end wall 16 it is engaged by the fins 23 of the vanes 22 and is lifted into the opening 48 of the stationary forage-receiving chamber 40. Note that the fins 23 extend radially into the mixing zone 20 to a greater extent than forward regions of the linear vanes 22. This is desired to provide more efficient direction of the forage into the forage-receiving chamber 40. However, if the entire linear extent of each vane had the same radial dimension as its loading fin 23, the vanes would obstruct the mixing zone 20 to an undesirable extent; thereby interfering with the tumbling and mixing action.

When the forage is directed into the opening 48 it is pulled into the forage-receiving chamber 40 by the rotation of auger 24 in a direction opposite to the direction of rotation of the mixing chamber 12. Rotation of the auger in the same direction as the mixing chamber would tend to throw the forage out of the forage-receiving chamber 40, rather than pull it in. Any long strands of forage which tend to bunch up in the opening will be cut by the shearing-type action resulting from the cooperation between the upper curved lateral wall 52 and the spiral flights of the auger 24. This prevents clogging, or blocking of the opening 48. The forage directed into stationary chamber 40 is then directed by the auger toward the forward end of the tubular housing 28, where it is either directed out of the mixing device 10 or recycled through the peripheral mixing zone 20, depending upon the position of the flap 58.

Although the present invention has been described with reference to the particular embodiment herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

I claim:

1. A mixing device for forage or similar product, said device including:

a rotatably mounted, inclined mixing chamber having a closed rear axial end lower than an open forward axial end, said chamber including an axially extending peripheral mixing zone between said rear and forward ends;

substantially linear mixing vanes extending forwardly from adjacent the rear end of the mixing zone for tumbling product when the chamber is rotated; an axially extending tubular housing within the mixing chamber for separating the peripheral mixing zone from a rotatably mounted axially extending auger within said housing, said auger communicating with the rear axial end of the mixing zone through a rear opening in said housing for receiving product from said mixing zone and feeding it toward and out of a forward axial end of said housing.

2. The mixing device of claim 1 wherein the tubular housing is rotatably mounted with the mixing chamber.

3. The mixing device of claim 2 including drive means for rotating the housing and mixing chamber in a direction opposite to the direction of rotation of the auger.

4. The mixing device of claim 1 including a stationary receiving chamber adjacent the rear axial end of the mixing chamber and having an opening therein for communicating the mixing zone with a rear end of said auger, said opening having at least one substantially curved edge which is laterally spaced from a second edge at one axial end of the opening, and which curves into engagement with said second edge at the opposite axial end of said opening to form a point, said curved edge cooperating with flights of said auger to cut or otherwise shred product tending to bunch up and block the opening of said receiving chamber.

5. The mixing device of claim 1 wherein the mixing vanes include radially extending fins adjacent the rear axial end of the mixing zone and in axial alignment with an opening into a stationary receiving chamber, said receiving chamber communicating the mixing zone with the rear opening in the housing, said fins being adapted to lift product and feed it into the opening of the receiving chamber.

6. The mixing device of claim 1 including a hinged flap adjacent a forward end of the tubular housing and movable between one position for directing product exiting the forward end of the housing out of the mixing chamber, and a second position for redirecting product exiting the forward end of the housing back into the mixing zone for recycling.

7. The mixing device of claim 3 wherein the drive means rotates the housing and mixing chamber at a speed of less than 10 rpm, and rotates the auger at a speed in excess of 150 rpm.

8. The mixing device of claim 1 wherein the housing and auger are centrally located within the mixing chamber and are inclined at substantially the same angle as the mixing chamber.

9. The mixing device of claim 1 wherein the direction of rotation is not reversible.

10. The mixing device of claim 1 wherein the only communication between the auger and the mixing chamber is at the rearward and forward ends of the mixing chamber.

11. The mixing device of claim 1 wherein the mixing vanes make less than a complete revolution about the circumference of the mixing chamber between its rear and forward ends.

* * * * *